US008925565B2

(12) United States Patent
Choi

(10) Patent No.: US 8,925,565 B2
(45) Date of Patent: Jan. 6, 2015

(54) HUB ASSEMBLY FOR A FOLDABLE TENT

(71) Applicant: Ki Ho Jin, Xiamen, Fujian (CN)

(72) Inventor: Kwan Jun Choi, Xiamen (CN)

(73) Assignee: Ki Ho Jin, Xiamen (CN)

( * ) Notice: Subject to any disclaimer, the term of this patent is extended or adjusted under 35 U.S.C. 154(b) by 0 days.

(21) Appl. No.: 13/870,714

(22) Filed: Apr. 25, 2013

(65) Prior Publication Data

US 2013/0233367 A1 Sep. 12, 2013

Related U.S. Application Data

(63) Continuation of application No. 12/658,473, filed on Feb. 4, 2010, now Pat. No. 8,448,656, which is a continuation-in-part of application No. PCT/CN2008/073142, filed on Nov. 21, 2008.

(30) Foreign Application Priority Data

Nov. 30, 2007 (CN) ..... 2007 2 0008991 U

(51) Int. Cl.
*E04H 15/48* (2006.01)

(52) U.S. Cl.
CPC ..... *E04H 15/48* (2013.01)
USPC ..... 135/135; 135/147

(58) Field of Classification Search
USPC ..... 135/93, 94, 114, 135, 120.3, 125, 136, 135/147
See application file for complete search history.

(56) References Cited

U.S. PATENT DOCUMENTS

| | | | | |
|---|---|---|---|---|
| 14,655 | A | 4/1856 | Hartwell | |
| 58,283 | A | 9/1866 | Palmer | |
| 379,274 | A | 3/1888 | Hamilton | |
| 2,113,118 | A | 4/1938 | Pyatt | |
| 2,306,706 | A | 12/1942 | Lucas | |
| 2,448,895 | A | 9/1948 | Lawrence | |
| 2,530,765 | A | 11/1950 | Greenup | |
| 2,555,220 | A | 5/1951 | Brown | |
| 2,731,972 | A | 1/1956 | Braun | |
| 2,948,287 | A | 8/1960 | Rupert | |
| 2,953,145 | A * | 9/1960 | Moss et al. | 135/98 |

(Continued)

FOREIGN PATENT DOCUMENTS

| | | | |
|---|---|---|---|
| CA | 2022369 | A1 | 2/1991 |
| CN | 1030790 | C | 1/1996 |

(Continued)

OTHER PUBLICATIONS

International Search Report, Jan. 22, 2009 for PCT/CN2008/073142.

*Primary Examiner* — Noah Chandler Hawk
(74) *Attorney, Agent, or Firm* — John H. Choi

(57) ABSTRACT

The present invention provides a roof connecting mechanism of a foldable tent wherein a connecting hub is pivotally connected to roof strut rods so that the roof strut rods are movable in a compact manner relative to the connecting hub. The connecting hub includes pivoting cabinets in radial arrangement for pivoting the ends of each roof strut rod which has sufficient space to accommodate the ends of the roof strut rods when the tent is both in an open and folded configuration. The connecting hub also includes a stopper to limit the movement of the roof strut rods when in the open configuration. Such construction allows for a simple and compact opening and folding of the tent.

6 Claims, 8 Drawing Sheets

(56) References Cited

U.S. PATENT DOCUMENTS

| | | | | |
|---|---|---|---|---|
| 2,962,034 | A | 11/1960 | Finlayson | |
| 2,984,249 | A | 5/1961 | Sears, Jr. et al. | |
| 3,054,413 | A | 9/1962 | Eshelman | |
| 3,333,373 | A | 8/1967 | Taylor et al. | |
| 3,738,378 | A | 6/1973 | Williams | |
| 3,810,482 | A | 5/1974 | Beavers | |
| 3,929,146 | A | 12/1975 | Maiken | |
| 4,077,417 | A | 3/1978 | Beavers | |
| 4,148,332 | A | 4/1979 | Huddle | |
| 4,201,237 | A | 5/1980 | Watts et al. | |
| 4,280,521 | A | 7/1981 | Zeigler | |
| 4,285,354 | A | 8/1981 | Beavers | |
| 4,627,210 | A | 12/1986 | Beaulieu | |
| 4,637,748 | A | 1/1987 | Beavers | |
| 4,750,509 | A | 6/1988 | Kim | |
| 4,787,182 | A | 11/1988 | Serge | |
| 4,819,680 | A | 4/1989 | Beavers | |
| 4,838,003 | A | 6/1989 | Zeigler | |
| 4,941,499 | A | 7/1990 | Pelsue et al. | |
| 4,966,178 | A * | 10/1990 | Eichhorn | 135/123 |
| 4,971,090 | A | 11/1990 | Uhl | |
| 5,195,551 | A * | 3/1993 | Ju | 135/126 |
| 5,293,890 | A | 3/1994 | Park et al. | |
| 5,328,286 | A | 7/1994 | Lee | |
| 5,333,634 | A | 8/1994 | Taylor | |
| 5,361,794 | A | 11/1994 | Brady | |
| 5,423,341 | A | 6/1995 | Brady | |
| 5,617,681 | A | 4/1997 | Lyons | |
| 5,628,338 | A | 5/1997 | Stumbo | |
| 5,634,483 | A | 6/1997 | Gwin | |
| 5,666,986 | A | 9/1997 | Fox | |
| 5,732,726 | A | 3/1998 | Lee | |
| 5,797,695 | A | 8/1998 | Prusmack | |
| 5,884,646 | A | 3/1999 | Ju | |
| 5,943,837 | A | 8/1999 | Esser et al. | |
| 6,021,795 | A | 2/2000 | Long et al. | |
| 6,032,430 | A | 3/2000 | Soukup | |
| 6,167,898 | B1 | 1/2001 | Larga et al. | |
| 6,286,530 | B1 | 9/2001 | Hussey | |
| 6,296,415 | B1 | 10/2001 | Johnson et al. | |
| 6,516,823 | B1 | 2/2003 | Glover et al. | |
| 6,591,571 | B2 | 7/2003 | Fritsche et al. | |
| 6,604,844 | B2 | 8/2003 | Hussey | |
| 6,666,223 | B2 | 12/2003 | Price et al. | |
| 6,772,780 | B2 | 8/2004 | Price | |
| 6,776,179 | B1 | 8/2004 | Chen | |
| 6,854,476 | B1 * | 2/2005 | Chai | 135/135 |
| 6,868,858 | B2 | 3/2005 | Suh | |
| 6,874,519 | B2 | 4/2005 | Chiang | |
| 6,892,744 | B2 | 5/2005 | Feldpausch et al. | |
| 7,025,075 | B2 | 4/2006 | Suh | |
| 7,040,585 | B2 | 5/2006 | Cheng et al. | |
| 7,059,094 | B2 | 6/2006 | Yamawaki | |
| D544,941 | S | 6/2007 | Rogers | |
| 7,311,113 | B2 | 12/2007 | Suh | |
| RE40,544 | E | 10/2008 | Suh | |
| 7,481,235 | B2 | 1/2009 | Prusmack | |
| 7,546,845 | B2 | 6/2009 | Prusmack | |
| 2003/0005953 | A1 | 1/2003 | Erbetta et al. | |
| 2007/0051399 | A1 | 3/2007 | Jung | |
| 2007/0215192 | A1 | 9/2007 | Hoffman | |

FOREIGN PATENT DOCUMENTS

| | | | |
|---|---|---|---|
| CN | 2506736 | Y | 8/2002 |
| CN | 2635827 | Y | 8/2004 |
| CN | 201129060 | Y | 10/2008 |
| GB | 2201703 | A | 9/1988 |
| GB | 2259927 | A | 3/1993 |

* cited by examiner

HUB ASSEMBLY FOR A FOLDABLE TENT

CROSS REFERENCES TO RELATED APPLICATIONS

This application is a continuation of U.S. patent application Ser. No. 12/658,473 entitled "Roof Connecting Mechanism of Foldable Tent," filed on Feb. 4, 2010, the subject matter of which is incorporated herein by reference.

BACKGROUND OF THE INVENTION

1. Field of the Invention

The present invention relates to a mechanism for facilitating the opening and closing of a tent, and more particularly to a hub or roof connecting mechanism of a foldable tent.

2. Description of Prior Art

Hubs or roof connecting mechanisms of foldable tents are often used for pivotally connecting tent poles to a central location so that the tent would be able to have a foldable function.

Roof connecting mechanisms or hubs in the conventional bell tents are only provided for purposes of connecting components of the tent such as roof strut rods or poles. In other words, those parts require assembly and disassembly when the tent is pitched and stored away, respectively.

In larger conventional tents, the roof connecting mechanism or hub is kept in hinge connection with the roof strut rods or poles such that when the tent is folded, all of the roof strut rods or poles centrally pivot around the hub and are bent down so that the poles are gathered closely together. However, the larger conventional tents also require that the poles be further supported by sub-braces which connect from the poles to a downward extended portion of the hub. As a result, not only do the connecting mechanisms of the sub-braces become intricate but the overall structure of the tent framework becomes complicated. Moreover, the volume of the tent is larger due to the number of the components of the hub assembly, and opening and closing the tent becomes more difficult.

OBJECTS AND SUMMARY OF THE INVENTION

It is therefore a main object of the present invention to provide a foldable canopy tent with a relatively smaller volume having a simplified roof connecting mechanism or hub for carrying out opening and closing functions without assembly or disassembly, that can also be manufactured at a low cost. For achieving the above-mentioned object, the present invention provides a roof connecting mechanism or hub of a foldable tent for pivotally connecting a plurality of radially spaced apart poles. The connecting hub comprises a base for preventing the poles from pivoting beyond the surface of the base.

A plurality of radially spaced apart slots are formed by a plurality of adjacent walls independently extending upward from the base to provide corresponding slots for receiving each pole. Each of the poles are pivotally connected to the radially inner portion of each slot such that the poles are prevented from downward pivotal movement beyond the base surface. Thus, when the tent is in an open configuration the poles rest on the top surface of the base, and when the tent is in a closed configuration the poles are pivoted upward.

Alternatively, the hub assembly can be inverted so that the plurality of adjacent walls extend downward from the base to provide corresponding slots for receiving each pole. Each of the poles are pivotally connected to the radially outer portion of each slot located at the bottom portion of the base such that the inner ends of the poles are prevented from upward pivotal movement beyond the bottom surface of the base. The base, however, is provided with an opening or void at the radially outer portions of the slots at a portion of the base opposing the pivotal connection of the poles. Thus, when the tent is in an open configuration the pole inner ends engage the bottom surface of the base, and when the tent is in a closed configuration the poles are pivoted upward through the opening of the base.

With respect to the poles, a cap having a curved outer surface is fixed to the inner end of each pole, and each pole and cap have a matching pivoting hole built upon the inner end of the pole for pivotally connecting the radially inner end of each pole to a corresponding slot. Alternatively, each of the poles could be directly pivotally connected to the walls of the slots without caps.

Each slot has a curved groove built on the inside portions of the walls for receiving the curved outer surfaces of each corresponding cap.

In operation, the tent of the present invention is opened by pivoting the poles downward and expanding the poles until the tent structure is completely spread out and the feet of the poles are fixed to the surface so that the hub above is supported. At the same time, the base of the hub prevents the poles from pivoting downward past the top surface of the base. Therefore, the hub assembly provides a balanced and simple structure when the tent is in the open configuration.

In the alternative embodiment having the inverted hub described above, the same occurs when opening the tent except that the base of the hub prevents the inner ends of the poles from pivoting upward past the bottom surface of the base, thus preventing the poles from pivoting downward past the base of the hub.

To fold or close the tent, the feet of the poles are disengaged with the surface and the poles are pivoted upward. The weight of the hub assists with this process as the hub is lowered and the poles are collectively pivoted upward into a compact configuration.

DETAILED DESCRIPTION OF THE PREFERRED EMBODIMENTS

Figure 1:
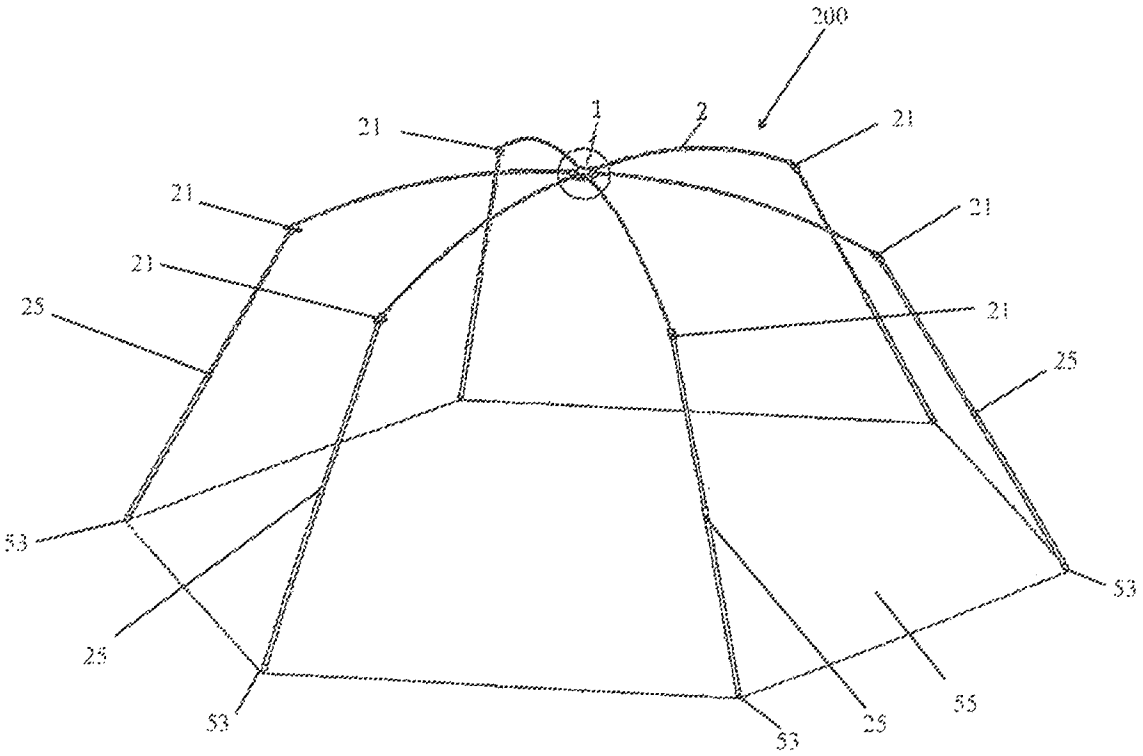
FIG. 1 is a perspective view of the foldable tent of the present invention with the roof connecting means of the first embodiment in an open configuration.
Figure 2:
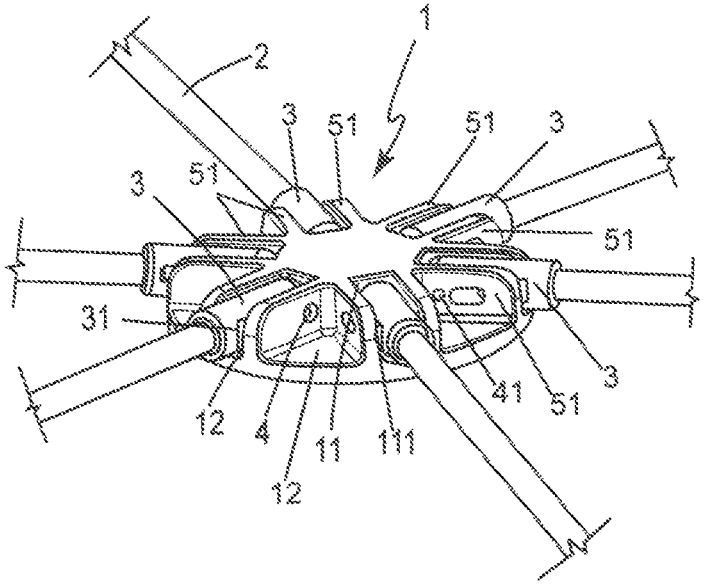
FIG. 2 is a partial perspective view of the first embodiment of the present invention in an open configuration.
Figure 3:
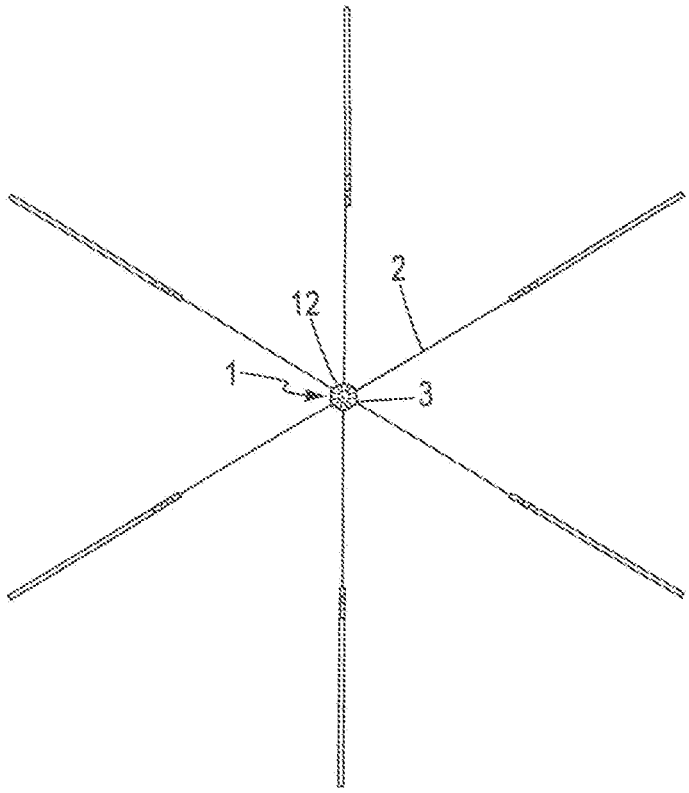
FIG. 3 is a plan view of the foldable tent of the present invention with the roof connection means of the first embodiment in a partially folded configuration.
Figure 4:
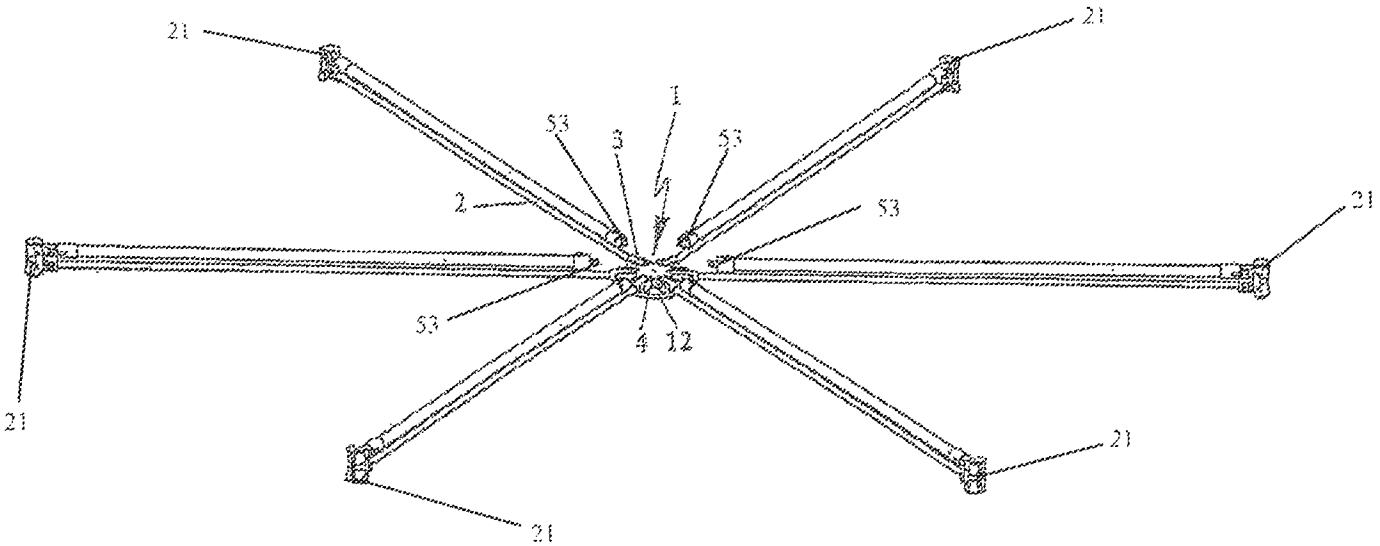
FIG. 4 is a perspective view of FIG. 3.

Referring to FIG. 1 to FIG. 4, a roof connecting mechanism or hub of foldable tent 200 having a canopy 55 in the first embodiment of the present invention is shown, in which the hub 1 is a circular piece having a plurality of pivoting cabinets or slots 11 extending upward from a stopper or base 12. Each slot 11 is formed by a pair of independently extending adjacent walls 51 that include a curved groove 111 built upon the inner portions of the walls 51 forming each slot 11. The slots 11 are uniformly arranged in a radial configuration. The walls of each slot have pivoting holes 41 such that the holes are substantially aligned.

The hub assembly further comprises a plurality of roof strut rods or poles 2, each having at least two sections coupled by a joint 21, and each pole 2 is received by a corresponding slot 11. Each of the poles 2 are telescoping via a telescope locking member 25 and allows for the poles 2 to compact further in the closed configuration as described in more detail below. A pivoting cap 3 having a curved lug or curved outer surface 31 is fixed on the inner end of each pole 2 such that each cap 3 is sufficiently secured or tightly fit onto each pole 2. It is preferred that the external diameter of the pivoting cap 3 is less than or equal to the width of the inside of the slot 11, which allows for the each pole 2 to pivotally maneuver in and out of each corresponding slot 11. Each corresponding pole and cap have holes extending through the pole and cap such that the holes are substantially aligned.

Figure 8:
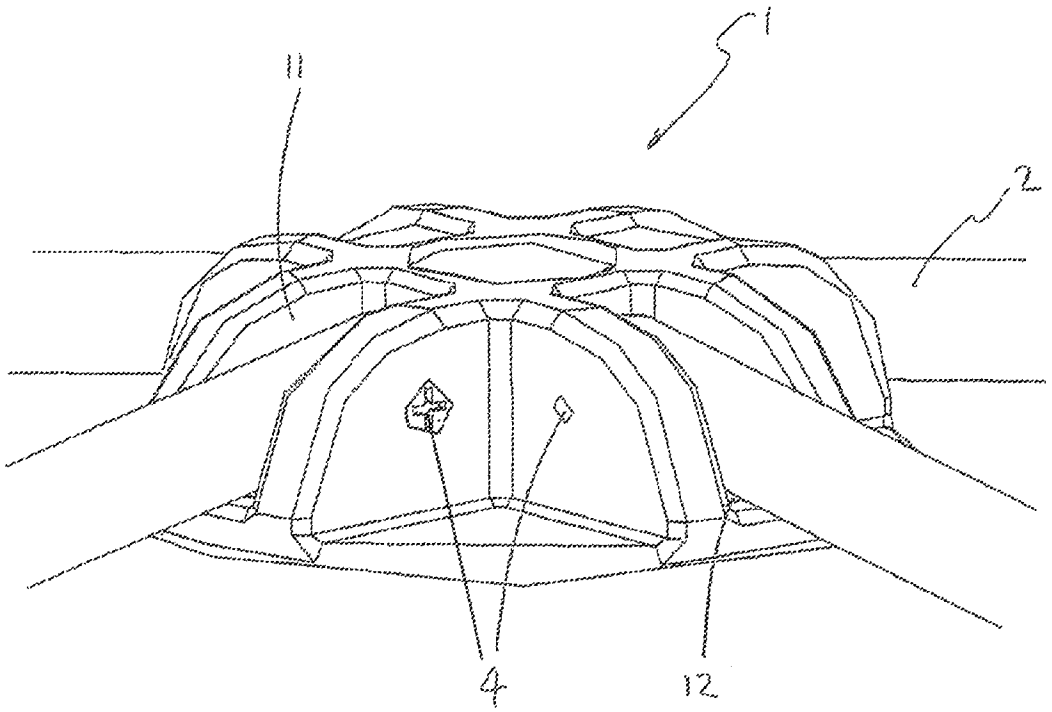
FIG. 8 is a partial perspective view of an alternative embodiment of the present invention.

The poles 2 extend radially outward from the hub 1 and each pole 2 is pivotally connected to a corresponding slot 11 proximate the radially inner end of each slot 11. A pivoting pin 4 extends through each cap 3 and corresponding pole 2 at a radially inner end of each cap 3 and each end of the pivoting pin 4 extends into the pivoting holes 41 on each side of the walls 51 of each slot 11 thereby forming a pivoting axis for the poles 2. The pivoting pin 4 can be any type of fastener such as a rod, bolt or screw as shown, for example, in FIGS. 2 and 8. Alternatively, the poles 2 can be directly connected to the connecting hub 1 without a pivoting cap as shown in FIG. 8.

In the first embodiment of the present invention, shown in FIGS. 1-4, the base 12 of each slot 11 extends to at least the portion of the poles 2 where the pivoting pins 4 are located and thus the inner ends of each pole 2 can pivot to and from the open and closed configurations within each corresponding slot 11.

In operation, the tent of the first embodiment is opened by pulling the frame of the tent, i.e., the poles 2, radially outward (see FIGS. 2-4) from the hub 1 such that the hub 1 is supported by the poles 2 and the poles 2 are telescopically extended, as shown in FIG. 1. The feet 53 of the poles 2 are then fixed to a supporting surface and the canopy 55 of the tent is expanded. Only an outline of the canopy 55 is shown in FIG. 1 so that the overall structure of the tent 200 can be sufficiently shown. During this time, each pole 2 is secured within each corresponding slot 11 through the engagement of the curved outer surface 31 of the caps 3 and the curved grooves 111 of the slot walls 51. Each pole 2 is further secured to each corresponding slot 11 by engaging the base 12 of the hub 1 and the tent 200 remains opened and securely erected.

Similarly, to close the tent the feet 53 of the poles 2 are first disengaged from the supporting surface. Without support from the feet of the poles 2, the hub 1 moves downward due to its weight and assists in the closing of the tent. The bottom portions of the poles 2 are telescopically retracted and folded radially inward toward the hub 1 (see FIGS. 3 and 4) and further pivoted radially inward until the poles 2 and canopy are gathered above the hub 1 in a compact closed configuration for convenient storage and transportability. The canopy is not shown in the FIGS. 2-4 in order to show the folding function in more detail.

Figure 5:
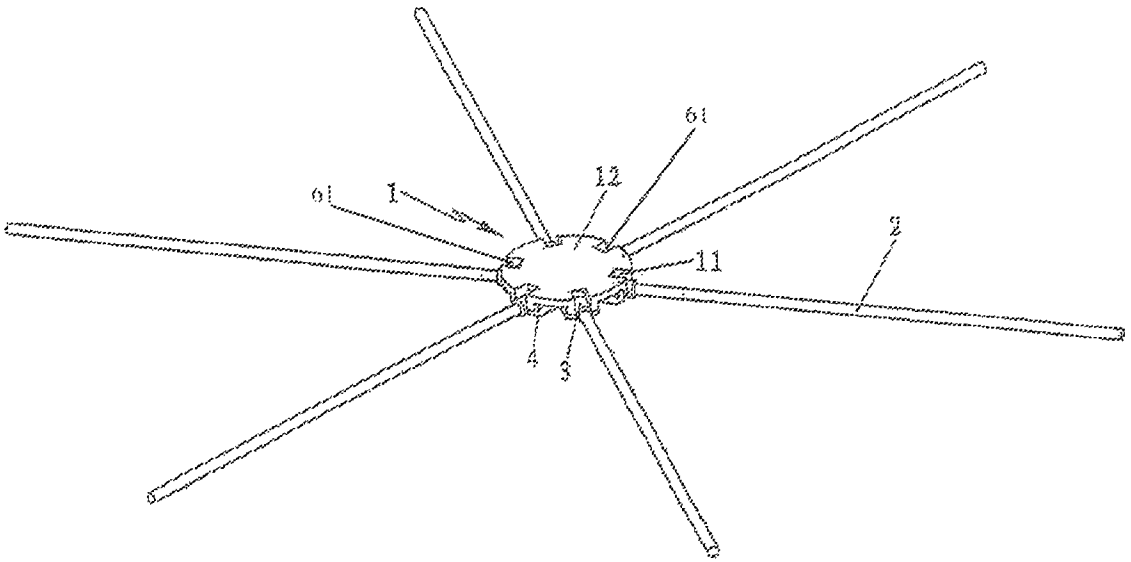
FIG. 5 is a partial top perspective view of the second embodiment of the present invention in an open configuration.
Figure 6:
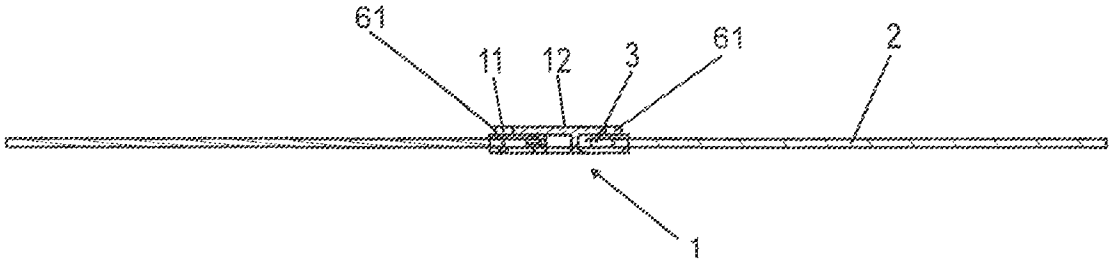
FIG. 6 is a partial cross-sectional view of FIG. 5.
Figure 7:
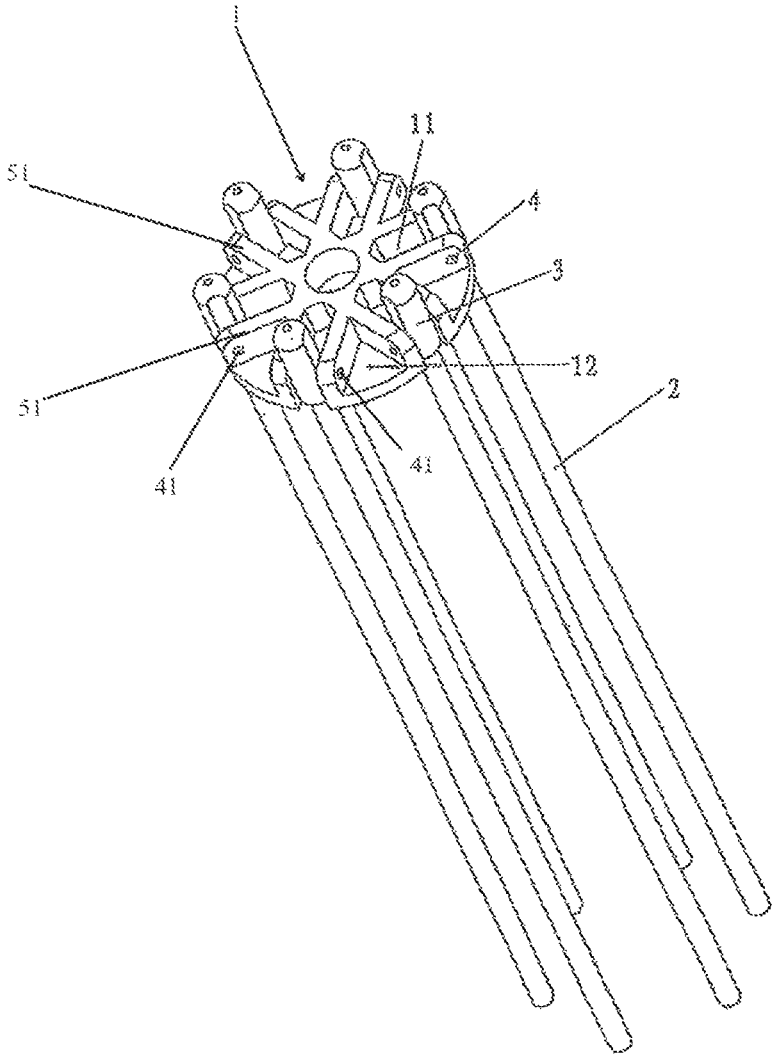
FIG. 7 is a partial bottom perspective view of the second embodiment of the present invention in a folded configuration.

Referring to FIG. 5 to FIG. 7, a roof connecting mechanism or hub 1 of the foldable canopy tent 200 in the second embodiment of the present invention is shown, in which a connecting hub 1 is a circular piece having a plurality of pivoting cabinets or slots 11 extending downward from a stopper or base 12. The canopy of the tent is not shown in FIGS. 5-7 so that the hub 1 can be shown in more detail. Each slot 11 is formed by a pair of adjacent walls 51 which extend independently from the base 12, and each slot 11 is uniformly arranged in a radial configuration. The walls 51 of each slot 11 have pivoting holes 41 such that the holes are substantially aligned.

The hub assembly further comprises a plurality of roof strut rods or poles 2 and, similar to the arrangement in the first embodiment, each pole 2 is received by a corresponding slot 11.

A pivoting cap 3 is fixed on the inner end of each pole 2 such that each cap 3 is sufficiently secured or tightly fit onto each pole 2. It is preferred that the external diameter of the pivoting cap 3 is less than or equal to the width of the inside of the slot 11, which allows for the cap 3 of each pole 2 to pivotally maneuver in and out of each corresponding slot 11. Each corresponding pole and cap have holes extending through the pole and cap such that the holes are substantially aligned.

The poles 2 extend radially outward from the hub 1 and each pole 2 is pivotally connected to a corresponding slot 11 proximate the radially outer end of each slot 11. A pivoting pin 4 extends through each cap 3 and corresponding pole 2 at a radially outer end of each cap 3 and each end of the pivoting pin 4 extends into the pivoting holes 41 on each side of the walls 51 of each slot 11, thereby forming a pivoting axis for the poles 2. Alternatively, the poles 2 can be directly connected to the connecting hub 1 without a pivoting cap as shown in FIG. 8.

Referring again to FIGS. 5-7, the base 12 extends radially outward except that the base does not extend above the radially outer portions of the slots 11 where the poles 2 are pivotally connected to the walls 51, thereby forming an opening or a void 61. Thus, the radially inner portion of the base 12 restricts the inner end of the poles 2 from any upward pivotal movement beyond the bottom surface of the base 12 and as a result prevents the poles 2 from any downward pivotal movement beyond a position substantially parallel to the base 12 in the open configuration of the tent (see FIGS. 5 and 6). Moreover, the opening or void 61 provided on the radially outer portions of the slots 11 allow the poles 2 to pivotally move upward to the closed configuration of the tent (see FIG. 7).

In operation, similar to the operation of the tent in the first embodiment, the tent of the second embodiment is opened by pulling the frame of the tent, i.e., the poles 2, radially outward (see FIGS. 5 and 6) from the hub 1 and in a downward direction such that the hub 1 is supported by the poles 2. The feet of the poles 2 are then fixed to the ground or other surface and the tent canopy is spread out, as illustrated in FIG. 1. During this time, the inner end of each pole 2 is secured within each corresponding slot 11 and the caps 3 of each pole 2 engages the bottom surface of the base 12 of the hub 1. Thus, the tent remains opened and securely erected.

Referring to FIG. 7, to close the tent, the feet of the poles 2 are first disengaged from the surface. Without support from the feet of the poles 2, the hub 1 moves downward due to its weight and assists in the closing of the tent. The poles 2 are folded radially inward toward the hub 1 as the radially inner ends of the poles 2 are pivoted to a position below the base 12. Thus, the poles 2 are gathered above the hub 1 in a compact closed configuration for convenient storage and transportability.

As described above, the slots 11 of the hub 1 not only restrict the poles 2 from pivoting beyond the base 12 in the open configuration but also provide for the poles 2 to pivot into a folded, compact closed configuration. Furthermore, the structure is simplified and the material cost is reduced while providing an easy and convenient opening and closing operation.

I claim:

1. A hub assembly for opening and folding a tent between an open configuration and a folded configuration, said hub assembly comprising:

a support member extending radially outward from a central longitudinal axis, a bottom portion of the support member having an engaging surface;

a plurality of slots formed on the support member, the plurality of slots uniformly spaced apart radially, each slot formed by first and second walls, each of the first and second walls extending from the engaging surface and substantially parallel to each other, each of the first and second walls having a hole to form a pair of holes extending normally through the walls of each slot, the pair of holes being substantially aligned;

a plurality of substantially tublar poles corresponding to the number of slots, each pole having an inner end and an outer end, with each inner end of each pole having a hole extending laterally through the inner end;

a plurality of pins corresponding to the number of slots, each pin of each slot defining a pivoting axis by extending through the hole of the first wall, the corresponding holes of each pole, and the hole of the second wall such that each pole inner end is pivotally connected therein each corresponding slot under a portion of the support member; and a plurality of substantially tubular caps, each cap having a length and fixed to the inner end of each pole, each opposing side of each cap having a hole such that the opposing holes are substantially aligned;

wherein in the open configuration the pole inner ends engage the engaging surface of the support member such that the inner ends of the poles are restricted from pivotal movement beyond the engaging surface, and in the folded configuration the poles are pivoted upward toward the central longitudinal axis to a position substantially perpendicular to the support member; and wherein an inner surface of each of the walls have a groove and an outer surface of each of the poles have a curved outer surface such that the cap outer surface engages the wall inner surface when the tent is in the open configuration.

2. A hub assembly for opening and folding a tent between an open configuration and a folded configuration, said hub assembly comprising:

a support member extending radially outward from a central longitudinal axis, a bottom portion of the support member having an engaging surface;

a plurality of slots formed on the support member, the plurality of slots uniformly spaced apart radially, each slot formed by first and second walls, each of the first and second walls extending from the engaging surface and substantially parallel to each other, each of the first and second walls having a hole to form a pair of holes extending normally through the walls of each slot, the pair of holes being substantially aligned;

a plurality of poles corresponding to the number of slots, each pole having an inner end and an outer end, with each inner end of each pole having a hole extending laterally through the inner end; and a plurality of pins corresponding to the number of slots, each pin of each slot defining a pivoting axis by extending through the hole of the first wall, the corresponding holes of each pole, and the hole of the second wall, such that each pole inner end is pivotally connected therein each corresponding slot under a portion of the support member;

wherein in the open configuration the pole inner ends engage the engaging surface of the support member such that the inner ends of the poles are restricted from pivotal movement beyond the engaging surface, and in the folded configuration the poles are pivoted upward toward the central longitudinal axis to a position substantially perpendicular to the support member; and wherein the engaging surface of each slot includes a void at a radially outer portion thereof, the pivoting axis extending from opposing walls below the void.

3. The hub assembly in claim 2, wherein in the folded configuration the inner ends of the poles are pivoted through the void.

4. A hub assembly for opening and closing a tent between an open configuration and a folded configuration, said hub assembly comprising:

a support member having an engaging surface at a bottom portion thereof, the support member extending radially outward from a central longitudinal axis of the support member;

a plurality of slots formed on the support member, each slot formed by a pair of walls extending from the engaging surface and integrally formed on the support member, the walls of each pair being substantially parallel to each other, each slot including a first pivoting axis formed substantially normal between the corresponding pair of walls;

a plurality of poles corresponding to the number of slots, each pole having an inner end and an outer end, with each inner end having a second pivoting axis internal to the inner end, the second pivoting axis oriented laterally through the inner end, the inner end of each pole connected to a corresponding slot wherein each of the first and second pivoting axis of the corresponding slot and pole are aligned for pivotal movement of each inner end about the second pivoting axis within the corresponding slot; and a plurality of caps, each cap having a length and fixed to the inner end or each pole, each opposing side of each cap having a hole such that the opposing holes are substantially aligned;

wherein in the open configuration the inner ends of the poles engage the engaging surface and are restricted from pivotal movement beyond said engaging surface, and in the folded configuration the inner ends of the poles are disengaged from the engaging surface such that the poles are gathered substantially perpendicular to the engaging surface; and wherein an inner surface of each of the walls have a groove and an outer surface of each of the caps have a curved outer surface such that the cap outer surface engages the wall inner surface when the tent is in the open configuration.

5. A hub assembly for opening and closing a tent between an open configuration and a folded configuration, said hub assembly comprising:

a support member having an engaging surface at a bottom portion thereof, the support member extending radially outward from a central longitudinal axis of the support member;

a plurality of slots formed on the support member, each slot formed by a pair of walls extending from the engaging surface and integrally formed on the support member, the walls of each pair being substantially parallel to each other, each slot including a first pivoting axis formed substantially normal between the corresponding pair of walls;

a plurality of poles corresponding to the number of slots, each pole having an inner end and an outer end, with each inner end having a second pivoting axis internal to the inner end, the second pivoting axis oriented laterally through the inner end, the inner end of each pole connected to a corresponding slot wherein each of the first and second pivoting axis of the corresponding slot and pole are aligned for pivotal movement of each inner end about the second pivoting axis within the corresponding slot; and a plurality of caps, each cap having a length and fixed to the inner end of each pole, each opposing side of each cap having a hole such that the opposing holes are substantially aligned;

wherein in the open configuration the inner ends of the poles engage the engaging surface and are restricted from pivotal movement beyond said engaging surface, and in the folded configuration the inner ends of the poles are disengaged from the engaging surface such that the poles are gathered substantially perpendicular to the engaging surface; and wherein the engaging surface of each slot includes a void at a radially outer portion thereof, the first and second pivoting axis extending from opposing walls below the void.

6. The hub assembly in claim 5, wherein in the folded configuration the inner ends of the poles are pivoted through the void.

* * * * *